United States Patent [19]

Huffman et al.

[11] 4,194,911

[45] Mar. 25, 1980

[54] INHIBITOR REMOVING BATH FOR DIRECT POSITIVE COLOR PHOTOGRAPHIC DEVELOPMENT

[75] Inventors: William A. Huffman, Minneapolis; R. Dean Lowrey, White Bear Lake; Geoffrey C. Nicholson, Woodbury; Bruce Wittnebel, White Bear Lake, all of Minn.

[73] Assignee: Minnesota Mining and Manufacturing Company, Saint Paul, Minn.

[21] Appl. No.: 596,651

[22] Filed: Jul. 17, 1975

Related U.S. Application Data

[63] Continuation-in-part of Ser. No. 429,667, Dec. 28, 1973, abandoned, which is a continuation-in-part of Ser. No. 325,455, Jan. 22, 1973, abandoned.

[51] Int. Cl.[2] ..... G03C 7/16; G03C 5/50

[52] U.S. Cl. ..... 430/357; 430/379; 430/957

[58] Field of Search ..... 96/22, 59

[56] References Cited

U.S. PATENT DOCUMENTS

| | | | |
|---|---|---|---|
| 3,246,987 | 4/1966 | Hanson et al. | 96/59 |
| 3,582,347 | 7/1971 | Holly et al. | 96/22 |
| 3,658,525 | 4/1972 | Bent et al. | 96/22 |
| 3,779,764 | 12/1973 | Moll et al. | 96/59 |
| 3,875,227 | 4/1975 | Kroll et al. | 96/22 |
| 3,883,354 | 5/1975 | Molenda | 96/22 |

OTHER PUBLICATIONS

Glatkides, Photographic Chemistry, vol. I, 1958, p. 140—Fountain Press, London, Eng.

Focal Encyclopedia of Photography, 1969, McGraw Hill, pp. 1298, 272, 273.

*Primary Examiner*—Travis Brown

*Assistant Examiner*—L. Falasco

*Attorney, Agent, or Firm*—Cruzan Alexander; Donald M. Sell; Mark A. Litman

[57] ABSTRACT

An inhibitor removing bath for effecting color formation in a color positive development process which bath comprises a color accelerating agent, a contrast control agent and a pH control agent. The inhibitor removing bath may further contain in a preferred embodiment a color reversal agent. A complete color photographic development process using this inhibitor removing bath is found to provide color positive transparencies of excellent quality.

6 Claims, No Drawings

INHIBITOR REMOVING BATH FOR DIRECT POSITIVE COLOR PHOTOGRAPHIC DEVELOPMENT

This application is a continuation-in-part application of U.S. Ser. No. 429,667, filed Dec. 28, 1973, now abandoned, which is, in turn, a continuation-in-part application of U.S. Ser. No. 325,455, filed Jan. 22, 1973, now abandoned.

A widely used process for reversal color development of silver halide photographic films employs a succession of baths through which exposed photographic films must be passed. For example, a first bath may include a black and white developing agent which reduces silver halide in latent image areas of a film to silver, forming negative silver image therein. Thereafter the film may be uniformly exposed to light to form fog centers in undeveloped areas of the film, and then treated with a color developer solution in which a color developing agent reduces silver halide in the fogged areas to silver, and is itself oxidized. The oxidation product of the developer reacts with one or more color couplers which may be distributed throughout various layers of the film to form dyes therein. The silver images may then be bleached from the film, and unreacted silver halide may be removed therefrom by "fixing" to thus provide positive, colored images. To avoid cross-contamination of the various processing baths, a number of intermediate wash baths are commonly employed. Further, a "stop" bath is ordinarily utilized to halt black and white development immediately after treatment of the film in the black and white developer bath.

As will be evident from the above description, the process described employs many steps and utilizes many different processing baths. In addition, the shelf-life of these prepared solutions are poor. Further, the above procedure must be very carefully regulated in order to provide satisfactory photographic color reproductions. Moreover, the time which is required to fully process an exposed roll of color film (a major cost factor) is inordinately long. A faster, more efficient, less-detailed color reversal development process is hence much to be desired.

A novel color reversal process for the rapid access positive color development of silver halide photographic elements which eliminates some of these steps and greatly reduces the complete development time was disclosed in copending U.S. applications Ser. Nos. 188,616, filed Oct. 12, 1971 now abandoned and 280,263, filed Aug. 14, 1972 now U.S. Pat. No. 3,883,354. The process disclosed therein develops color photographic elements through the use of a monobath developing solution. A single developing solution which comprises a combination of at least one color developing agent, at least one black and white developing agent, each having given electromotive potentials, and a dye-formation inhibitor. Upon oxidation of the color developing agent by the silver halide of the emulsion, the dye formation inhibitor prevents the formation of a color image by combining or associating with the oxidized color developer. To form the color positive image, the inhibiting effect on the oxidized color developer must be reduced sufficiently to allow development of a dye image or be removed. In the instance where the oxidized color developer is inhibited from coupling with dye couplers in the emulsion because of the formation of salts with the oxidized developer (as by the addition of a sufficient concentration of sulfite ions to the bath), the inhibiting moiety should be removed as by washing the element with water. All of this is disclosed in the above-mentioned copending U.S. applications, the entire disclosures of which are incorporated herein.

The essential characteristics of the color reversal process and developing monobath of U.S. Ser. No. 280,263 now U.S. Pat. No. 3,883,354 are as follows:

Monobath—an aqueous solution containing at least one photographic color developing agent in a total color developing agent concentration of at least about 0.02 moles/liter capable, upon oxidation thereof, of reacting with a photographic color coupler to form a dye; at least one black and white color developing agent having a polarographic half-wave potential at pH 10.0 of from about −10 millivolts to about −187 millivolts; and a water-soluble, dye-formation inhibitor in sufficient quantity to restrain substantially all dye formation in a silver halide photographic element and in an absolute concentration of at least about 0.10 moles/liter, the molar ratio of inhibitor to color developer being at least about 0.97.

Process—(1) immersing a silver halide, color photographic element having a latent image therein into the monobath solution of the invention to imbibe said silver halide element (the emulsion layer thereof containing the silver halide) with said monobath solution to develop solely a negative black and white silver image therein; (2) thereafter fogging said silver halide layer to render said layer developable in non-imaged areas; (3) treating said silver halide layer to reduce the inhibiting effect of said dye formation inhibitor without intermediate removal of said imbibed solution; and (4) allowing development therein of a positive color image in the presence of a color coupler.

It has been found in the practice of the above-mentioned color reversal process that although sharp prints with viewable color densities and contrasts are formed when the monobath developed elements are washed, as with water, it is desirable to enhance the densities and tones produced by such processing.

This invention relates to a treatment bath, and more specifically to a wash bath, which when used as the wash bath in the process of U.S. Application Ser. No. 280,263 now U.S. Pat. No. 3,883,354 after immersion of the element into the monobath developing solution, significantly enhances the densities and tones of the final color image.

In another aspect, this invention relates to a process for rapid access positive color development of silver halide photographic elements.

In a further aspect, this invention relates to wash bath compositions which will remove dye formation inhibiting effects present within silver halide photographic elements as a result of immersion in the developer monobath and partial development (without the subsequent washing step) according to the process of U.S. Ser. No. 280,263 now U.S. Pat. No. 3,883,354 (hereinafter the Molenda process). By use of the term partial development, the fact that the silver image has been developed while the dye image has been prevented is emphasized.

SUMMARY OF THE INVENTION

After an exposed color photographic element has been immersed in the monobath of the Molenda process, there is substantially no colored dye present in the resultant image due to the effect of the dye formation inhibitor. In order to achieve a satisfactory color image, this inhibiting effect must be removed in the subsequent wash bath. In many instances, water alone is sufficient to remove much of the inhibiting effect, however, the final images may not be as good as those obtainable through other processes, without further treatment.

It has been found that many different enhancing functions may be included into this inhibitor removing bath so that the final color image is at least comparable to those resultant from other processing techniques. It has further been found that these functions may be combined into one bath without adverse interreaction between the components and without greatly extending the total processing time for the Molenda process.

It has been found that if, at a minimum, four washing environment characteristics or processing functions are provided in wash baths following development in the Molenda monobath, color images of very high quality can be produced. These functions which must be provided are:

1. color accelerating,
2. color reversal [nucleating or fogging],
3. contrast control, and
4. a pH control agent (buffering within a particular pH range).

It should be noted that light may be used for the color reversal and that the inhibitor removing bath providing functions necessary for effective inhibitor removal may actually be more than one bath if desired. After immersion in the Molenda monobath these four functions or only 1, 3, and 4 following a light reversal step may be provided by the use of specific classes of compounds in a wash bath. The compounds which provide these functions are those compounds known in the art as: (1) color accelerating agents, (2) color reversal agents, (3) contrast control agents, and (4) buffering or pH control agents. It is an obvious consideration in the selection of components for this bath that the individual components should also be selected for mutual compatibility.

Color accelerating agents are those materials known in the photographic art which speed up color dye formation in the development of photographic reversal films. Examples of such are ethylene diamine and $\beta$-phenyl ethyl amine. Further examples may be found in Mason, *Photographic Processing Chemistry*, Focal Press p 259 ff.

Color reversal agents, also known in the art as nucleating agents or fogging agents, cause sites with developmental sensitivity to form on silver halide grains in the photographic emulsions. These sites activate the grain so that it may be developed into an image by reduction to metallic silver, as by p-phenylene diamine developers. Fogging agents are discussed, for example, in G. F. Duffin, *Photographic Emulsion Chemistry*, Focal Press, pp. 202–3, and 224 (1966); and P. Glafkides, *Photographic Chemistry*, Vol. II, Foundation Press, pp 626–7 (1960).

Contrast control agents are those materials which control the gradation of the intensity of dye images in color photographic processing. The dye density gradient in a photographically developed emulsion can be reduced by using less silver halide or by reducing the size of the silver halide grains. To achieve the desired gradient by these methods, however, requires either the use of insufficient silver halide to generate acceptable images in the first instance, or the sacrifice of sensitivity in the emulsion with small grain sizes. U.S. Pat. Nos. 3,520,690; 2,742,832, and 2,689,793 disclose numerous compounds known in the art as contrast control agents. Specific examples of contrast control agents are soluble alkali metal iodo- and bromo- salts such as KI, KBr, etc. or citrazinic acid. Bromine salts are preferred.

The buffering agent should maintain a pH in the inhibitor removing bath of from at least about pH 11.0 to about pH 13.0. The preferred pH range for these buffering agents would be from about 11.7 to 12.5.

When the pH control or buffering agent contains the phosphate ion, it has been found that only limited concentrations thereof are tolerable. When the concentration of the phosphate ion excedes 0.05 moles/liter, an undesirable green cast develops in the image. Therefore, when phosphate ion is used in the inhibitor removing bath of the present invention, it should be in a concentration of less than 0.5 moles/liter.

The amounts of the four agents which must be in the inhibitor wash bath to effect the desired results depends to some degree upon the active strength of the particular compound selected to provide that function. The minimum amounts, based on a few selected and preferred compounds for the agents (e.g., ethylene diamine, hydrazine, sodium borohydride, potassium bromide) are as follows:

1. color accelerating agent in sufficient quantity to enable the developed color photographic element to have a minimum Dmax of 1.5. This is approximately a minimum amount of 0.05 moles/liter.

2. color reversing agent in sufficient quantity to render a color photographic element developable in non-imaged areas (non-photosensitized areas, or silver halide grains not having developable latent image). This is approximately a minimum amount of $1.6\times10^{-3}$ moles/liter.

3. contrast control agent in sufficient quantity to yield a contrast ($\gamma$) in a color photographic element of 2.4 or less. Preferably a gamma range of 0.9–2.4 is desired. This is a minimum of about $4\times10^{-3}$ moles/liter.

After development of the colored, positive image, the ordinary process steps normally used in finishing the picture should be used here. That is, after the bath to remove the inhibiting effect, there should be an acid stop bath, then bleach bath, fix bath (or bleach/fix bath), wash, and stabilizing bath. Hardeners may be added to any or all of the stop, bleach, fix or bleach/fix baths, or a prehardening bath may be used prior to development in the monobath. The compositions of such baths are well known in the art and need not be discussed here.

Between the development bath and the bath to remove the inhibitor a quick wash step has been found desirable to remove the solution retained on the surface of the photographic element so as to prevent contamination of the latter bath. This wash is not of sufficient length or intensity as to reduce the inhibiting effect, but is only used to remove the solution held by surface tension on the photographic element. Of course if one is using water as the inhibitor removing second bath such a quick wash would be unnecessary.

Certain other known photographic addenda may be added to the inhibitor removing bath. Stabilizers or antioxidants such as sulfite and escorbic acid may be added. However, when the inhibitor removing bath is to remove a sulfite inhibitor from the photographic emulsion being processed, it is desirable to keep the concentration of sulfite in the bath at minimum levels.

Other addenda such as color developing agent may be added to the inhibitor removing bath. In small quantities, such color developer may enhance the dye image or cause no change in image quality. Again, however, only limited amounts of color developer are tolerable in the inhibitor removing bath. It has been found that when the concentration of color developer in the bath exceeds one-half the molar concentration necessary for full color development (i.e, to generate an optical density of 3.0), the quality of the image is significantly reduced. It is therefore desirable to have in the inhibitor removing bath no more than one-half the molar concentration of color developer necessary to produce full color development.

The invention will be further illustrated by the following Examples.

PREPARATION A

A commercially available photographic film coated with red, green and blue sensitive layers of silver halide (Ektochrome X) was exposed through a wedge (continuous, logarithmic density) in a sensitometer. The exposed film was then immersed in a developing monobath comprised of:

Water: 850 ml.;
Sodium sulfite: 48.0 g.;
Sodium hexametaphosphate: 2.0 g.;
2-methyl-4(N-ethyl-N-β-hydroxyethyl)amino aniline sulfate salt: 28.0 g.;
Hydroquinone: 6.0 g.;
Sodium thiocyanate: 0.5 g.;
Potassium bromide: 2.0 g.;
Potassium iodide: 0.01 g.;
Sodium carbonate: 30.0 g.;
Water to 1000;
Sodium hydroxide to a pH of 10.2 (about 4.0 g.)

for 3.5 minutes at 73° F. These color photographic elements as yet had no developed color image due to the action of the dye formation inhibitor.

Film strips partially developed in the above developing bath composition were used as the film strips in those following examples where inhibitor removing baths are illustrated. The term "partially developed" as used in the context of this invention refers to the fact that the silver image has been developed, but the color dye image has not been developed because of the dye formation inhibiting effect of the development baths of the Molenda process.

EXAMPLE I

A partially developed film strip (according to Preparation A) was placed in a bath of water for 5 seconds to remove droplets of the monobath from the surface of the film. The film was then immersed in an inhibitor-removing bath (without a color accelerating agent) made of:

FORMULATION I

Water: 2850 ml.;
Sodium borohydride (color reversal agent): 0.150 g.;
Hydrazine (color reversal agent): 0.075 ml.;
Potassium bromide (contrast control agent): 3.0 g.;
$Na_3PO_4 \cdot 12H_2O$ (buffering agent): 12.0 g.;
$Na_2SO_3$: 0.3 g.;
KI solution (1 g/l): 30 ml.;
Water to: 3000 ml.

The pH was adjusted to 12.29 by adding sodium hydroxide solution. The film was then immersed in a stop bath solution of:

Glacial acetic acid: 12.0 ml.;
Sodium acetate: 6.3 g.;
Water to 1000 ml.

for 1 minute; thence into a bleach bath of:

Water: 800 ml.;
Potassium ferricyanide: 112.0 g.;
Potassium bromide: 24.0 g.;
Disodium hydrogen phosphate: 12.0 g.;
Sodium thiocyanate: 12.5 g.;
Sodium dihydrogen phosphate: 12.5 g.;
Water to 1000 ml.

for 2.5 minutes. At this time, the dye image is visible. Removal of the silver halide occurs when the film is fixed in a solution of:

Water: 800 ml.;
Ammonium thiosulfate (60% aqueous solution): 120 g.;
Sodium metabisulfite: 20.0 g.;
Water to 1000 ml.

Washing twice with water removes residual thiosulfate, so that the film dries to a clear state.

Densitometry of the film shows:

| | Dmin. | Contrast | Dmax. |
|---|---|---|---|
| To blue light | .35 | .5 | 2.1 |
| To green light | .35 | .5 | 1.2 |
| To red light | .20 | .5 | 1.2 |

EXAMPLE II

The above developing process was repeated. The bath contained, in addition to the components listed above in Formula I, 12.5 ml/l of ethylene diamine (a color accelerating agent). The bath gave densitometry results as follows:

| | Dmin. | Contrast | Dmax. |
|---|---|---|---|
| To blue light | .28 | 1.65 | 3.40 |
| To green light | .35 | 1.45 | 2.85 |
| To red light | .20 | 1.35 | 2.85 |

As can be seen from the densitometric data of this example, the color accelerating agent in combination with the other three essential agents of the wash bath yields much more satisfactory color densities than does a wash bath containing only the three agents (reversing agent, buffering agent, and contrast control agent).

EXAMPLE III

An inhibitor removing bath of the following composition was made to investigate the effects of pH variance on the sensitometric qualities of the developed images.

Water: 2850 ml.;
$Na_3PO_4$: 12 g.;
KI solution (1 g/l): 30 ml.;
KBr: 3.0 g.;
$Na_2SO_3$: 0.3 g.;
Ethylene diamine: 37 ml.;
Water to: 3000 ml.

The bath was split into four portions. In the first and second, 18 mg. hydrazine and 37 mg. borohydride were added. The third and fourth portions contained 6 mg. t-butylamine borane. The first and third portions were adjusted to a pH of 11.0, and the second and fourth portions adjusted to a pH of 12.3, all pH control accomplished by the addition of a sodium hydroxide solution.

The film was processed as described earlier, using each of the inhibitor removing bath portions, and the following sensitometric results were obtained:

| | Portion 1 | | |
|---|---|---|---|
| | fog | contrast | Dmax |
| blue | .12 | .5 | 1.96 |
| green | .36 | .5 | 1.86 |
| red | .28 | .5 | 1.60 |

| | Portion 2 | | |
|---|---|---|---|
| | fog | contrast | Dmax |
| blue | .28 | 1.65 | 3.40 |
| green | .35 | 1.45 | 2.85 |
| red | .20 | 1.35 | 1.85 |

| | Portion 3 | | |
|---|---|---|---|
| | fog | contrast | Dmax |
| blue | .10 | .6 | 1.62 |
| green | .36 | .6 | 1.38 |
| red | .26 | .6 | 1.34 |

| | Portion 4 | | |
|---|---|---|---|
| | fog | contrast | Dmax |
| blue | .18 | 1.65 | 2.6 |
| green | .40 | 1.50 | 2.6 |
| red | .34 | 1.65 | 3.3 |

The data shows the significant effect of pH levels upon the quality of the images produced by this method of developing color images.

EXAMPLE IV

The effect of contrast control agents was examined by making three inhibitor removing wash baths as follows:

Water: 1 l.;
Sodium borohydride: 50 mg.;
Hydrazine: 25 mg.;
Sodium sulfite: 0.1 g.;
$Na_3PO_4H_2O$: 4.0 g.;
Ethylene diamine: 12.0 g.;
NaOH to pH: 12.2.

In the first bath 0.05 g. of KBr was added, in the second 1.0 g. of KBr and in the third 2.0 g. of KBr.

The density results were:

| | | K Br | K Br | K Br |
|---|---|---|---|---|
| | | .05 | 1.0 | 2.0 |
| Dmin | To blue light | .30 | .30 | .17 |
| | To green light | .24 | .28 | .25 |
| | To red light | .18 | .36 | .32 |
| Mean Contrast | | | | |
| | To blue light | 1.65 | 1.56 | 1.65 |
| | To green light | 2.20 | 2.00 | 1.85 |
| | To red light | 1.82 | 1.81 | 1.68 |
| Dmax | To blue light | 3.25 | 3.68 | 3.04 |
| | To green light | 3.67 | 3.54 | 3.04 |
| | To red light | 3.60 | 3.45 | 3.14 |

The sensitometric data clearly show that desirable contrast and Dmax are dependent upon the use of contrast control agents in the inhibitor removing bath.

Water: 925 ml.;
Calgon (sodium hexametaphosphate): 2.0 g.;
4-N,N-diethylamino-o-toluidine: 6.0 g.;
Potassium sulfite: 48.0 g.;
Phenidone: 0.3 g.;
Hydroquinone: 6.0 g.;
Potassium bromide: 2.0 g.;
Potassium iodide: 0.01 g.;
Sodium thiocyanate: 0.5 g.;
Sodium carbonate: 30.0 g.;
Water to: 1 l.;
Sodium hydroxide to pH of: 10.2.

The exposed film was immersed in this bath for 3.5 minutes at 73° F. It was washed for five seconds and then immersed in an inhibitor removing bath consisting of:

Water: 1 l.;
Sodium borohydride: 50 mg.;
Hydrazine: 25 mg.;
Ethylene diamine: 12.0 g.;
Potassium bromide: 1.0 g.;
Sodium sulfite: 0.1 g.;
$Na_3PO_4$ 12 $H_2O$: 4.0 g.;
NaOH to pH of: 12.2.

The stop, bleach, fix, and wash steps were repeated as in previous examples.

Densitometry readings were:

| | Dmin. | Dmax. |
|---|---|---|
| To blue light | .56 | 3.26 |
| To green light | .65 | 2.58 |
| To red light | .45 | 2.70 |

EXAMPLE V

Another developing bath according to U.S. Application Ser. No. 280,263 now U.S. Pat. No. 3,883,354 was used to partially develop Ektochrome X, exposed as in Preparation A. This developing bath consisted of:

Water: 925 ml.;
Sodium/hexametaphosphate: 2.0 g.;
2-methyl-4(N-ethyl-N-β-hydroxy ethyl)amino aniline sulfate salt: 22.0 g.;
Potassium sulfite: 48.0 g.;
Phenidone: 0.30 g.;
Hydroquinone: 5.0 g.;
Potassium bromide: 2.0 g.;
Potassium iodide: 0.01 g.;
Sodium thiocyanate: 0.5 g.;
Sodium carbonate: 30.0 g.;
Water to: 1 l.;
Sodium hydroxide to pH: 10.2.

The exposed film was immersed in the monobath at 73° F. for 3–5 minutes. After a five-second wash in tap water, the inhibitor removing wash bath described in the previous instance was used to completely develop the color in the film. Following the stop, bleach, fix and wash operation, densitometry was:

| | Dmin. | Dmax. |
|---|---|---|
| To blue light | .24 | 3.20 |
| To green light | .28 | 2.65 |

-continued

| | Dmin. | Dmax. |
|---|---|---|
| To red light | .30 | 2.50 |

The same monobath was used to partially develop similarly exposed film, but the ethylene diamine concentration was reduced to 5 gm/l in the inhibitor removing wash bath. Densitometry readings were lower in the Dmax.

| | Dmin. | Dmax. |
|---|---|---|
| To blue light | .23 | 2.70 |
| To green light | .34 | 2.15 |
| To red light | .34 | 2.10 |

Note in this comparison that the reduced concentration of color developer in the Molenda developer bath and of ethylene diamine in the inhibitor removing wash bath lowers the Dmax to an undesirable level.

The sensitometric parameters, contrast, and Dmax, have been indicated throughout the specification as primarily dependent upon the contrast control agent and the color accelerating agent respectively, as is correct in this developing procedure. Any significant variation in the other components (pH control agent, and reversing agent) will also secondarily affect these parameters, but as previously stated, the primary effects on those particular parameters are caused by the contrast control agent and color accelerating agent once the pH range is established and the color reversal is effected.

What we claim is:

1. An inhibitor removing bath for effecting color formation in an exposed color photographic element which has already undergone a color reversal which bath comprises:

(a) color accelerating agent selected from the group consisting of ethylene diamine and $\beta$-phenyl ethyl amine in a concentration of at least 0.05 moles/-liter, (b) contrast control agent selected from the group consisting of alkali metal salts of iodine and bromine, and citrazinic acid, and (c) pH control agent providing a pH of 11 to 13 within the bath, said bath further comprising less than 0.05 moles of phosphate and the absence of color developer.

2. An inhibitor removing bath comprising:

(a) color accelerating agent selected from the group consisting of ethylene diamine and $\beta$-phenyl ethyl amine in a concentration of at least 0.05 moles/-liter, (b) contrast control agent selected from the group consisting of alkali metal salts of iodine and bromine, and citrazinic acid, (c) color reversal agent present in a concentration of at least $1.6\times10^{-3}$ moles/liter, and (d) pH control agent providing a pH of 11 to 13 within the bath, said bath further comprising less than 0.05 moles of phosphate and the absence of color developer.

3. The inhibitor removing bath of claim 2 wherein the color reversal agent is selected from the class of borohydrides, amine complexed boranes and hydrazine.

4. The inhibitor removing bath of claim 3 wherein the contrast control agent is selected from potassium iodide and potassium bromide.

5. A color photographic color reversal development process which comprises:

(a) treating a color photographic element having a hydrophilic colloid silver halide layer bearing a latent image with an aqueous monobath solution which includes at least one photographic color developing agent in a total color developer concentration of at least about 0.02 moles/liter capable, upon oxidation, of reacting with a photographic color coupler to form a dye, a black and white photographic developer including at least one black and white developing agent having a polarographic half-wave potential at pH 10.0 of from about −10 millivolts to about −187 millivolts, and a water-soluble dye-formation inhibitor in a concentration of at least about 0.10 moles/liter and in molar ratio to the color developing agent of at least about 0.97, thereby to imbibe said silver halide layer with said monobath solution and to develop solely a negative black and white silver image therein;

(b) thereafter fogging said silver halide layer so as to render said layer developable in non-imaged areas, and (c) without intermediate removal of said imbibed monobath solution, treating said layer to reduce the inhibiting effect of said dye formation inhibitor with the inhibitor removing bath of claim 1.

6. The process of claim 5 wherein fogging is effected by the addition of at least $1.6\times10^{-3}$ moles/liter of a color reversal agent to the inhibitor removing bath.

* * * * *